United States Patent [19]

Wallis

[11] 4,343,228

[45] Aug. 10, 1982

[54] HYDRAULIC CYLINDER ARRANGEMENT

[76] Inventor: Bernard J. Wallis, 25200 Trowbridge Ave., Dearborn, Mich. 48124

[21] Appl. No.: 204,337

[22] Filed: Nov. 5, 1980

Related U.S. Application Data

[63] Continuation of Ser. No. 6,274, Jan. 25, 1979, abandoned.

[51] Int. Cl.[3] ..... F15B 15/22; F15B 13/042

[52] U.S. Cl. ..... 91/457; 91/394; 91/408; 91/447; 91/448; 60/456

[58] Field of Search ..... 91/454, 443, 457, 447, 91/448, 394, 408; 60/456

[56] References Cited

U.S. PATENT DOCUMENTS

| | | | |
|---|---|---|---|
| 1,692,034 | 11/1928 | Griffen | 91/443 |
| 2,402,712 | 6/1946 | Vickers et al. | 91/443 |
| 2,698,604 | 1/1955 | Edwards | 91/443 |

FOREIGN PATENT DOCUMENTS

| | | | |
|---|---|---|---|
| 1189502 | 3/1965 | Fed. Rep. of Germany | 91/454 |

*Primary Examiner*—Paul E. Maslousky

*Attorney, Agent, or Firm*—Barnes, Kisselle, Raisch & Choate

[57] ABSTRACT

A hydraulic cylinder arrangement of the type wherein the opposite ends of a cylinder are connected selectively to either a pump or sump by a control valve. Each end of the cylinder is provided with a pair of oppositely acting, uni-directional check valves, each connected to a port on the control valve by an individual conduit. The four check valves are so arranged that all the fluid discharged from either end of the cylinder in response to the reciprocation of the piston therein is constrained to flow to sump before it is pressurized and returned to the cylinder.

3 Claims, 3 Drawing Figures

HYDRAULIC CYLINDER ARRANGEMENT

This is a continuation of application Ser. No. 6,274, filed Jan. 25, 1979, and entitled "Hydraulic Cylinder Arrangement", now abandoned.

This invention relates to reciprocating hydraulic cylinders.

Many machine tools and other devices utilize hydraulic cylinders for reciprocating a mechanical component in a more or less continuous manner. The valve assembly for controlling the cylinders is frequently located remotely from the cylinders, usually at a control panel, and connected therewith by hydraulic conduits. In such hydraulic circuits it is not uncommon to utilize heat exchangers at the control panel for cooling the hydraulic fluid that is recirculated between the cylinder and the hydraulic pump.

One of the problems that arises in connection with such circuits is that, unless the volume of the hydraulic fluid displaced by a cylinder is substantially greater than the volume of each of the hydraulic lines connecting the cylinder with the control valve, a large portion of the fluid displaced from the cylinder will simply flow back and forth in the hydraulic lines between the cylinder and the control valve and will not reach the heat exchanger. Under such conditions the hydraulic fluid can become heated to a relatively high temperature. This not only produces erratic operation, but also tends to cause deterioration of the hydraulic seals.

The primary object of this invention is to provide a means for insuring that all of the hydraulic fluid discharged from either end of a hydraulic cylinder is constrained to circulate back to the sump tank where it may be cooled before it is directed back to the cylinder through the control valve. This object is achieved by an arrangement of a pair of uni-directional check valves within or directly adjacent each end of the cylinder.

Other objects, features and advantages of the present invention will become apparent from the following description and accompanying drawings, in which.

Figure 1:
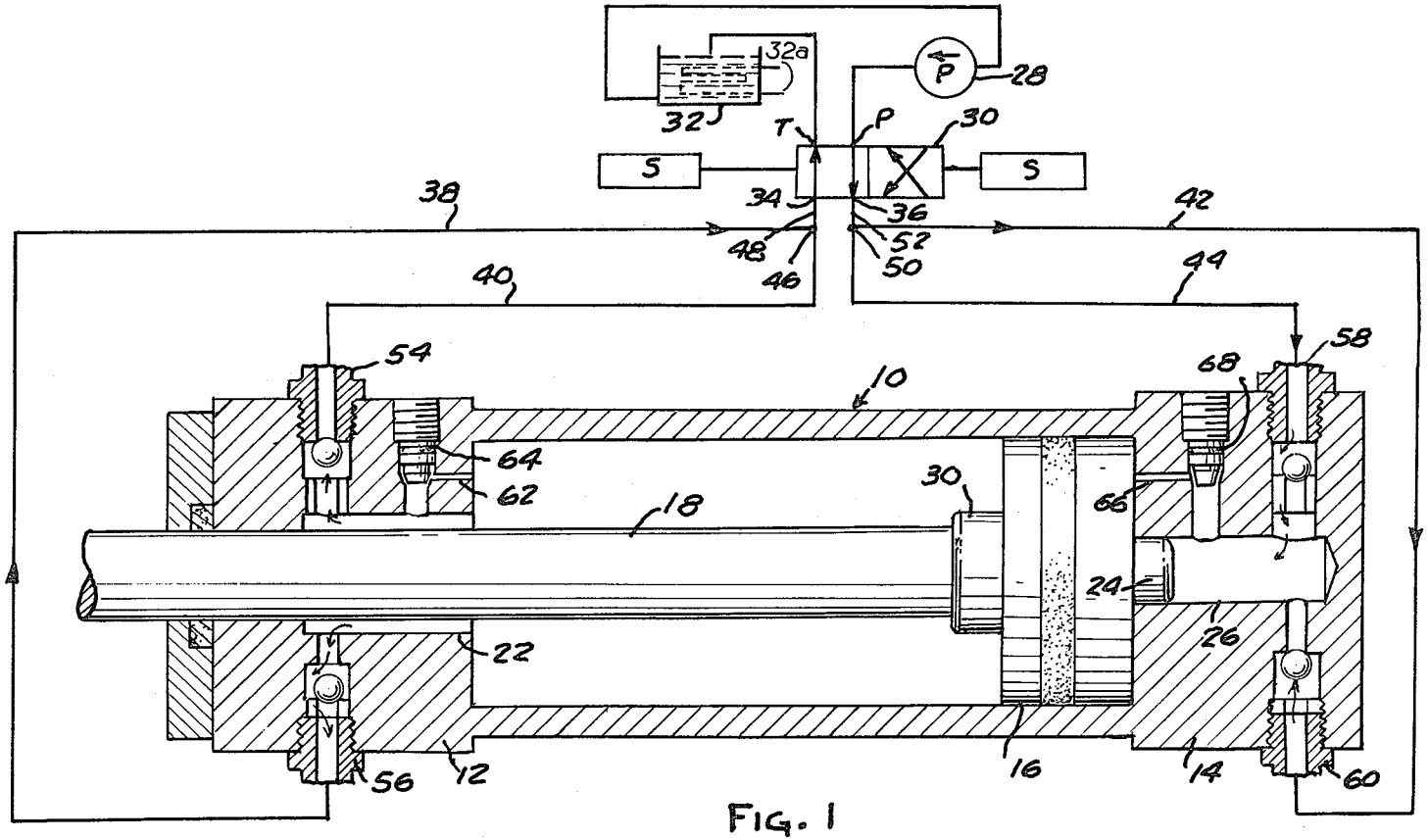
FIG. 1 is a sectional view, partly diagrammatic, showing one form of hydraulic cylinder circuit arrangement of the present invention.

In FIG. 1 there is illustrated at 10 a hydraulic cylinder having cylinder heads 12,14 at the opposite ends thereof. Within cylinder 10 there is arranged a piston 16 having piston rod 18 connected to one side thereof and extending axially through head 12. At the junction of piston rod 18 and piston 16 the piston rod has a concentric cylindrical enlargement 20 which, when the piston is fully displaced in a direction toward the left as viewed in FIG. 1, has a relatively close fit with a bore 22 in head 12. The opposite side of piston 16 has a central cylindrical projection 24, which, when the piston is disposed at the opposite end of its stroke (in the position indicated in FIG. 1), has a close fit with a bore 26 in head 14.

In the arrangement illustrated in FIG. 1 the means for operating the cylinder comprises a motor-driven pump 28 and a two-position, four-way valve 30. Valve 30 has a port P connected with the outlet of pump 28 and a port T connected with sump tank 32. Tank 32 is also connected to the inlet of pump 28. Valve 30 also has two ports 34,36 which, in response to operation of the valve, communicate with either pump 28 or tank 32.

Port 34 is connected with head 12 by two conduits 38,40. Port 36 is connected with head 14 by two conduits 42,44. As a practical matter, the two conduits 38,40 are connected together by a tee as at 46 and the tee is connected to port 34 by a short pipe fitting 48. Likewise, conduits 42,44 are connected as by a tee 50 and the tee is connected by a short pipe fitting 52 with port 36.

Within head 12 there are arranged to unidirectional check valves 54,56. Check valves 54,56 operate in a manner opposite to one another. More specifically, when the pressure of the fluid within cylinder 10 on the side of piston 16 adjacent head 12 is greater than the pressure of the fluid in conduits 38,40 (the condition illustrated in FIG. 1), valve 54 closes and prevents communication between the cylinder and line 40 and valve 56 opens and establishes communication between the cylinder and line 38. On the other hand, when the pressure in lines 38,40 is greater than the pressure in the cylinder at the left of piston 16, valve 54 opens communication between line 40 and the cylinder and valve 56 closes communication between line 38 and the cylinder. If desired, the check valves can be spring biased to operate in the manner described above.

Head 14 at the opposite end of the cylinder is also provided with two unidirectional check valves 58,60. Conduit 42 is connected with check valve 60 and conduit 44 is connected with check valve 58. Check valve 58 operates in the same manner as check valve 54 and check valve 60 operates in the same manner as check valve 56. Thus, if conduits 42,44 are pressurized (the condition shown in FIG. 1), check valve 58 opens and check valve 60 closes. On the other hand, if conduits 42,44 are connected to tank 32 through valve 30 and conduits 38,40 are pressurized, valve 58 closes and valve 60 opens.

Head 12 is formed with a passageway 62 extending between the interior of cylinder 10 and bore 22. A plug 64 is threaded into head 12 and is adjustable to vary the restriction in passageway 62. Similarly, a passageway 66 is formed in head 14 and an adjustable restrictor plug 68 is provided for controlling the flow of passageway 66.

In the condition of the circuit shown in FIG. 1 lines 42,44 are connected through valve 30 to pump 28. Accordingly, as explained above, pressurized fluid is permitted to flow into bore 26 from line 44 through check valve 58. The pressurized fluid in conduit 42 is prevented from being directed into bore 26 by reason of the fact that check valve 60 is closed. While piston 16 is abutting head 14, the pressurized fluid in bore 26 acts against the end of cylindrical extension 24 and through passageway 66 against a limited area of the piston. However, as soon as the piston moves slightly to the left, the presence of passageway 66 enables the pressurized fluid to act against the entire adjacent face of the piston. Thus, piston 16 is displaced to the left in cylinder 10. Thus, displacement is permitted by reason of the fact that check valve 56 is opened and conduit 38 communicates with tank 32 through valve 30. Check valve 54 is closed and, thus, no fluid is discharged through conduit 40. As soon as enlargement 20 enters bore 22, the piston is decelerated to a rate determined by restrictor 64.

Assuming now that piston 16 is at the opposite end of its stroke abutting head 12, if the spool of valve 30 is shifted to the left from the position shown in FIG. 1, conduits 38 and 40 are then connected to pump 28 and conduits 42,44 are connected to tank 32. At this time check valve 54 opens and check valve 56 closes and piston 16 is displaced in a direction toward the right in cylinder 10. Since conduits 42,44 are connected to tank 32 and piston 16 moves toward the right, check valve 58 closes and check valve 60 opens. Thus, all of the fluid being discharged from the cylinder is constrained to flow to tank 32 throgh conduit 42. When the piston approaches the end of its stroke adjacent head 14, restrictor 68 in passageway 66 decelerates the piston in the manner previously described with respect to restrictor 64 in passageway 62.

With the above described arrangement it will be observed that, regardless of which way piston 16 is being displaced in cylinder 10, all of the fluid being discharged from the cylinder is constrained to flow to tank 32 before it is directed back into the cylinder. This is true regardless of how remote the cylinder is located from the control valve. A suitable heat exchanger 32*a* may be arranged within or in combination with tank 32 to cool the discharged fluid. Thus, regardless of the rate or frequency of reciprocation of piston 16, all of the fluid discharged from the cylinder is recirculated to tank 32 and all of the fluid directed to either end of the cylinder from the pump has been cooled.

Figure 2:
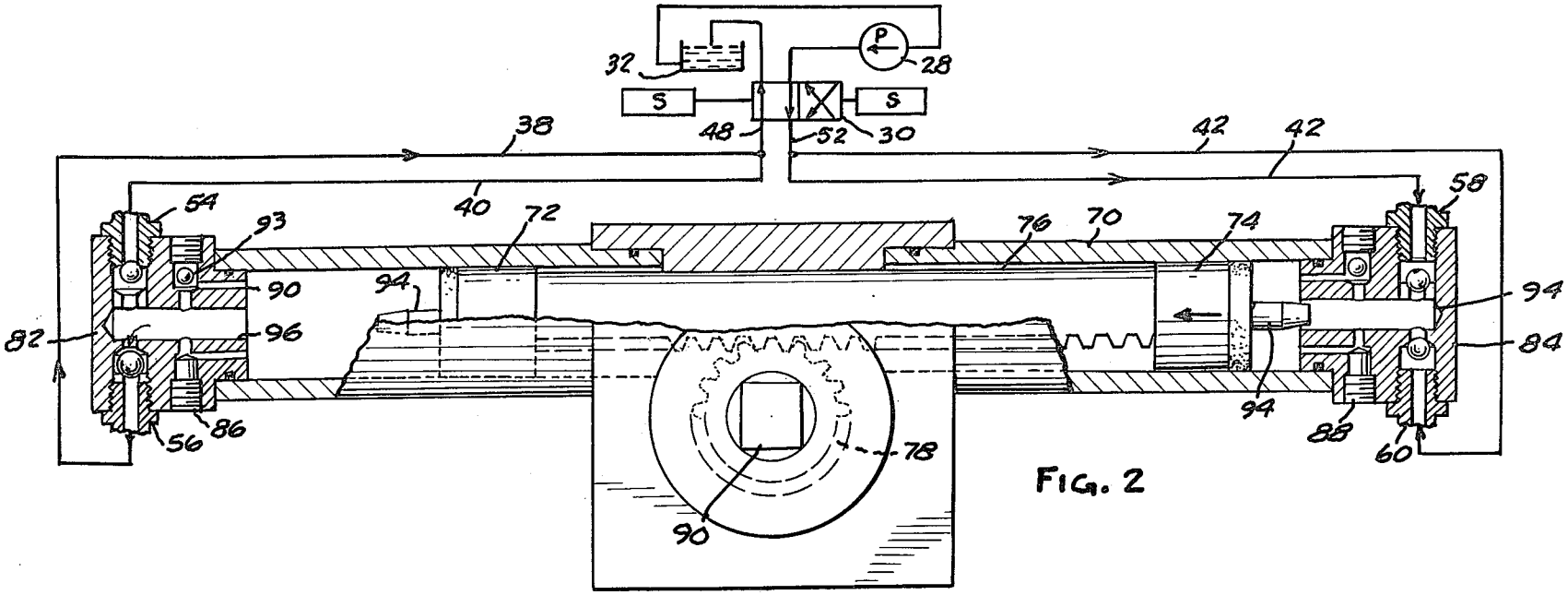
FIG. 2 illustrates another embodiment of the hydraulic cylinder circuit arrangement of the present invention.

The arrangement shown in FIG. 2 is in general similar to that shown in FIG. 1. In this arrangement within cylinder 70 two pistons 72,74 are slidably arranged and interconnected by a gear rack 76. Gear rack 76 meshes with a pinion 78 on a shaft 80. Accordingly, shaft 80 oscillates or rotates in opposite directions in response to reciprocation of pistons 72,74. The opposite ends of cylinder 70 are closed by heads 82,84. Within head 82 there is arranged an adjustable restrictor 86 and a similar restrictor 88 is arranged in head 84. Within each head there is formed an additional passageway 90 in which there is arranged a check valve 92. Each check valve 92 is adapted to close when the adjacent end of the cylinder is pressurized. Each piston 72,74 is formed with an axial projection 94 which, when the piston approaches the adjacent head, enters into a bore 96 with which it has a relatively close fit. Passageways 90 and check valves 92 are provided for imparting greater acceleration to the pistons at the beginning of their strokes without impairing the deceleration characteristics imparted thereto by the restrictors 86,88 on the return stroke of the pistons. In other respects the arrangement shown in FIG. 2 operates in substantially the same manner as the arrangement shown in FIG. 1. All of the fluid discharged from either end of cylinder 74 is constrained to flow to tank 32 where it is cooled before it is directed back into either end of the cylinder.

In the arrangement shown in FIG. 2 the pump 28, valve 30 and tank 32 are the same as illustrated in FIG. 1. Likewise, as in the arrangement shown in FIG. 1, conduit 42 connects with check valve 60, conduit 44 connects with check valve 58, conduit 38 connects with check valve 56, and conduit 40 connects with check valve 54. These check valves in the arrangement shown in FIG. 2 operate in exactly the same manner as the corresponding check valves shown in FIG. 1.

Figure 3:
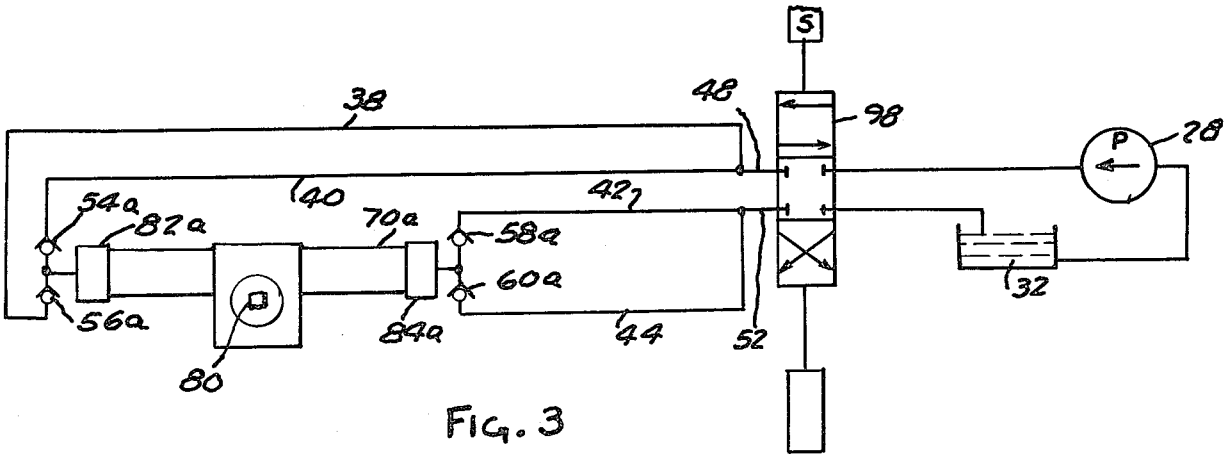
FIG. 3 is a diagrammatic view of still another form of hydraulic cylinder circuit arrangement of the present invention.

The diagrammatic showing in FIG. 3 is in principle the same as the arrangement shown in FIG. 2. In FIG. 3 the valve 98 is a three-position, four-way, closed-center valve rather than a two-position, four-way valve. Likewise, the check valves 54*a*,56*a*,58*a*,60*a* are shown diagrammatically mounted externally and directly on, rather than within, the heads 82*a*,84*a* of cylinder 70*a*. These check valves are connected with valve 98 by conduits 38,40,42,44 in the same manner as the previous embodiments described. The arrangement shown in FIG. 3 operates in the same manner as those previously described. As long as the unidirectional check valves are arranged within or directly adjacent the heads at the opposite ends of the cylinder, all of the oil discharged from the opposite ends of the cylinder is constrained to flow to tank before it is directed back into the cylinder. As pointed out above, this insures the necessary cooling of the oil.

I claim:

1. In combination, a hydraulic cylinder having a bore therein, a piston adapted to be reciprocated axially between the opposite ends of the bore in response to a differential pressure across the piston, said piston being connected to a work output member, a pair of unidirectional, oppositely acting check valves directly adjacent each end of the cylinder, one side of each check valve being directly connected with the adjacent end of the cylinder bore by means forming a short passageway, two pairs of relatively long, individual hydraulic conduits connected at one end, one each to the other side of each check valve, the other ends of the individual conduits in each pair being connected together, a control valve located remotely from said cylinder and having a plurality of ports thereon, one of said ports connected to a pump, another of said ports being connected to sump, a heat exchanger for cooling the oil returned to sump, the connected ends of one pair of said conduits being connected with a third port on the control valve by means forming a short passageway and the connected ends of the other pair of conduits being connected to a fourth port on said control valve by means forming another short passageway, said control valve being operable to supply hydraulic fluid under pressure to either of said third or fourth ports and simultaneously connect the other of said third and fourth ports with sump, said individual conduits each having a length many times greater than the length of all of said short passageways, said check valves providing the sole communication between said conduits and the cylinder bore and being responsive at all times to open and close in response to the pressure differential between the adjacent end of the cylinder bore and the associated conduit so that one of the long conduits in each pair comprises an inlet passageway to the cylinder and the other an outlet passageway from the cylinder, whereby, when the piston is reciprocated between the opposite ends of said bore, all of the fluid discharged through said outlet passagway conduits from the opposite ends of the cylinder is constrained by said oppositely acting check valves to flow to sump before it is directed back into either end of the cylinder through said inlet passageway conduits.

2. The combination called for in claim 1 including a head at each end of the cylinder closing the opposite ends thereof, said check valves being carried by said head members.

3. The combination called for in claim 2 wherein said check valves are disposed internally of said head members.

* * * * *